US010400399B1

(12) United States Patent
van der Wende et al.

(10) Patent No.: US 10,400,399 B1
(45) Date of Patent: Sep. 3, 2019

(54) SUPPORT LAYER FOR SUPPORTING AN ARTIFICIAL TURF ASSEMBLY, AND ARTIFICIAL TURF SYSTEM

(71) Applicants: Synprodo B.V., Wijchen (NL); Saltex Oy, Alajarvi (FI)

(72) Inventors: Anjo Antonius Johannes van der Wende, Wijchen (NL); Dave Johannes Hendrikus Petrus Gijsberts, Wijchen (NL); Petrus Antonius Maria De Bruijn, Wijchen (NL)

(73) Assignees: SYNPRODO B.V., Wijchen (NL); SALTEX OY, Alajarvi (FI)

( * ) Notice: Subject to any disclaimer, the term of this patent is extended or adjusted under 35 U.S.C. 154(b) by 0 days.

(21) Appl. No.: 15/934,050

(22) Filed: Mar. 23, 2018

(30) Foreign Application Priority Data

Mar. 23, 2017 (NL) ..... 2018565

(51) Int. Cl.
*E01C 13/08* (2006.01)
*E01C 13/02* (2006.01)
*E01C 13/04* (2006.01)

(52) U.S. Cl.
CPC ..... *E01C 13/083* (2013.01); *E01C 13/02* (2013.01); *E01C 13/045* (2013.01); *E01C 2201/10* (2013.01)

(58) Field of Classification Search
CPC combination set(s) only.
See application file for complete search history.

(56) References Cited

U.S. PATENT DOCUMENTS 8,221,856 B2 * 7/2012 Stroppiana ..... A47G 27/0468 428/17
8,225,566 B2 * 7/2012 Prevost ..... E01C 13/08 52/177

(Continued)

FOREIGN PATENT DOCUMENTS

CN 105887623 A 8/2016
CN 205893861 U 1/2017

(Continued)

OTHER PUBLICATIONS

Dutch Search Report dated Mar. 29, 2017 for NL 2018565 (7 pages).

(Continued)

*Primary Examiner* — Kyle Armstrong
(74) *Attorney, Agent, or Firm* — Shumaker, Loop & Kendrick, LLP

(57) ABSTRACT

A support layer for supporting an artificial turf assembly. The support layer being formed of a polymeric foam, preferably having a density of between 20 and 70 grams per liter, such as a polyolefin foam; and having an upper side and a lower side, wherein in use the support layer has been placed with the lower side thereof on a base surface and supports, on the upper side thereof, the artificial turf assembly, the support layer including a plurality of through drainage holes extending from the upper side to the lower side for allowing liquid such as rain water to flow via the plurality of drainage holes from the upper side to the lower side, and also including a plurality of channels at the lower side for allowing liquid such as rain water to flow through the channels along the lower side, wherein each of said plurality of drainage holes debouches into one of the plurality of channels. The support layer is further included in an artificial turf system, that includes an artificial turf assembly with the support layer supported on a base surface such as (Continued)

a layer of sand, wherein the support layer forms, at the upper sides thereof, a closed support surface supporting the artificial turf assembly.

13 Claims, 4 Drawing Sheets

(56) References Cited

U.S. PATENT DOCUMENTS

| | | | | |
|---|---|---|---|---|
| 2013/0101777 | A1 | 4/2013 | Sawyer et al. | |
| 2013/0102403 | A1* | 4/2013 | Vachon | E01C 3/006 472/92 |
| 2017/0335524 | A1* | 11/2017 | Sawyer | E01C 13/02 |

FOREIGN PATENT DOCUMENTS

| | | | | |
|---|---|---|---|---|
| EP | 2154291 | A1 | 2/2010 | |
| NL | 1029940 | C1 | 3/2007 | |
| WO | WO-2017211183 | A1 * | 12/2017 | E01C 13/08 |

OTHER PUBLICATIONS

European Search Report dated Aug. 15, 2018 for EP 18163740 (2 pages.).

* cited by examiner

SUPPORT LAYER FOR SUPPORTING AN ARTIFICIAL TURF ASSEMBLY, AND ARTIFICIAL TURF SYSTEM

TECHNICAL FIELD

The present invention relates to a support layer for supporting an artificial turf assembly, and to an artificial turf system. The support layer of the present invention may be used as supporting layer for artificial turf systems, for example for use in athletic fields (e.g. soccer fields), for equestrian applications, in ornamental lawns and gardens, and in children's playgrounds.

BACKGROUND

Artificial turf is widely used for athletic fields/courses for playing sports such as soccer, field hockey, football, rugby, golf, etc., and for playgrounds as well as for equestrian use. An artificial turf system is known and it typically buildup of a base layer or foundation layer (e.g. compacted sand or dirt, concrete, asphalt, gravel, or other compacted particulate or granulate material; said foundation layer being graded so that water will not form pools on the field), a support layer (e.g. according to the present invention) and the artificial turf (comprising a porous turf backing to which a plurality of plastic grass-like filaments/strands are attached, preferably comprising an infill material between approx. the lower half to two-third of the vertically arrange filaments).

SUMMARY

In an aspect the invention relates to a support layer, according to claim 1, for supporting an artificial turf assembly. Said support layer has been formed of a polymeric foam, preferably having a density of between 20 and 70 gram per liter, such as a polyolefin foam; and has an upper side and a lower side. In use the support layer has been placed with the lower side thereof on a base surface and supports, on the upper side thereof, the artificial turf assembly. The support layer comprises a plurality of through drainage holes extending from the upper side to the lower side for allowing liquid such as rain water to flow via the plurality of drainage holes from the upper side to the lower side, and also comprises a plurality of channels at the lower side for allowing liquid such as rain water to flow through the channels along the lower side, wherein each of said plurality of drainage holes debouches into one of the plurality of channels. An effect of the support layer according to the invention is the provision of shock absorption and dewatering to the artificial turf covering said support layer thereby improving safety and user-friendliness for users of said artificial turf. In an embodiment the support layer may have been formed as a plate element, preferably being a rectangular plate element. Alternatively the support layer may be provided on a roll.

In an embodiment the plurality of channels extend mutually parallel and are fluidly connected to each other by means of a plurality of cross channels. This way, any liquid such as rain water may easily flow along the lower side of the layer.

The plurality of cross channels may have a smaller cross sectional area than the plurality of channels, the plurality of cross channels preferably having a smaller width and/or a smaller depth than the plurality of channels.

In an embodiment the plurality of channels extend in a length direction, the plurality of cross channels extending, mutually parallel, at an angle in the range of 20 to 90 degrees, preferably from 20 to 60 degrees, more preferably from 30 to 50 degrees, to the length direction.

In an embodiment the support layer comprises a plurality of individual elevated portions at the upper side of the support layer. An effect of the elevated portions is an improved drainage of liquid to the individual drainage holes.

The plurality of elevated portions may be dome, pyramid, truncated pyramid, cone, truncated cone or tetrahedron shaped. They preferably are pyramid shaped.

Each of the plurality of elevated portions may have at least three of the plurality of drainage holes along the circumference thereof preferably wherein each of the elevated portions has a triangular or quadrilateral shape, in plan view, wherein a drainage hole is present at each of the corners of said shape. Each of the plurality of elevated portions preferably has a quadrilateral shape, further preferably square shape, in plan view, wherein a drainage hole is present at each of the four corners of said quadrilateral shape.

The plurality of drainage holes are provided in parallel rows extending in a first direction, the holes in each of the rows being spaced apart at a constant pitch, so as to define an area between each at least three directly adjacent drainage holes, preferably between four directly adjacent holes, wherein an elevated portion of the plurality of elevated portions is formed on each area.

Each two adjacent drainage holes in neighbouring rows may be spaced apart at a distance, wherein said distance is equal to the pitch, defining a square area between four directly adjacent drainage holes, which area is thus covered by one of the elevated portions.

Drainage holes, preferably each drainage hole, of the plurality of drainage holes may have a widened entrance portion at the upper side of the support layer. As a result, drainage of liquid at the upper side of the support element is improved. In an embodiment the widened entrance portion is star-shaped or cross-shaped in plan view, each arm of the shape being sloped, that means gradually sinks into the support layer from a free end of the arm towards the hole.

In an embodiment at least two of the arms extend in line with the direction of extension of the rows. In case of a cross-shaped entrance portion preferably the remaining two arms extend perpendicular to the direction of extension of the rows. In case of rectangular or square elevated portions, the arms thus each extend in between a part of the circumference of two respective adjacent elevated portions.

An elevation of each of the plurality of elevated portions may be in the range of 1 to 5 mm. A maximum thickness of the support layer may be in the range of 10 to 40 mm, preferably in the range of 15 to 30 mm, such as between 20 and 25 mm. A depth of the plurality of channels may be in the range of 25 to 75 percent of a total thickness of the support layer, preferably in the range of 30 to 50 percent. Said polymeric foam may have a material density of between 20 and 70 gram per liter, preferably between 30 and 50 gram per liter. In case that the support layer is in the form of a plate element, the surface area in plan view of the support plate element is in the range of 0.5 to 4 $m^2$, preferably wherein the plate element is rectangular having a length in the range of 0.5 to 4 m and a width in the same range, the length further preferably in the range of 1 to 2 m, still further preferably about 1.6 m, the width further preferably in the range of 1 to 1.5 m, still further preferably about 1.15 m.

Said polymeric foam may be a polyolefin foam, preferably a polyethylene foam (expanded polyethylene) or polypropylene foam (expanded polypropylene) or a mixture thereof. The polymer of the foam may be a homopolymer, e.g. a homo-polypropylene or a homo-polyethylene, or it may be a co-polymer, e.g. a copolymer of ethylene and propylene. Mixtures of homopolymers and/or co-polymers may also be envisaged. In addition, mixture of the same type of polymer may be used having a different density, for example a first EPP having a first density and a second EPP having a second density. Other examples of suitable materials are expanded polylactic acid (EPLA), expanded polystyrene (EPS) and mixture of all of these. The materials for use in the support layer according to the present invention may be so-called virgin (new) materials or may be recycled materials. Mixture of virgin and recycled materials may also be used. Any combination of type of polymer, density of polymer and origin (virgin versus recycled) may be used. In other words, said polymeric foam may be a polyolefin foam, preferably a polyethylene foam (expanded polyethylene EPE), polypropylene foam (expanded polypropylene EPP), polylactic acid foam (expanded polylactic acid EPLA), polystyrene foam (expanded polystyrene EPS), co-polymer foam comprising at least monomers, preferably ethylene and propylene, or one or more mixtures of these polymeric foams.

The support layer may have connecting elements at a circumferential edge thereof for connecting the support layer to further support layers such that the support layers are flush with respect to each other, preferably wherein the connecting elements are arranged for connecting the layer to a further layer in a form-closed manner such as a dovetail joint. This way, a large area may be covered by a plurality of support layers, preferably being in the form of plate elements, which plurality of support layers are effectively connected to each other.

The invention also relates to an artificial turf system, comprising an artificial turf assembly, a support layer according to the invention, preferably said support layer being in the form of a plurality of panel elements as described above, supported on a base surface such as a layer of sand, wherein the (plurality of panel elements of the) support layer forms, at the upper sides thereof, a closed support surface supporting the artificial turf assembly.

Embodiments of the support layer according to the invention as described above are also applicable for the artificial turf system according to the present invention.

BRIEF DESCRIPTION OF DRAWINGS

The present invention is described hereinafter with reference to the accompanying drawings in which an embodiment of the present invention is shown and in which like reference numbers indicate the same or similar elements.

DETAILED DESCRIPTION

Figure 11:
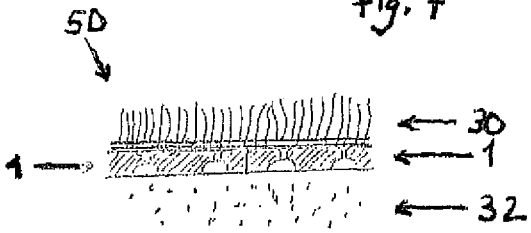
FIG. 11 shows an artificial turf system according to the present invention.

FIGS. 1-10 and 12 show a support layer 1 according to the invention. The support layer is arranged for supporting an artificial turf assembly 30 in use. The support layer 1 is in that case part of a plurality of such support layers 1 of a support system 50 according to FIG. 11, the system 50 further comprising an artificial turf assembly 30, that means, an assembly forming a surface of synthetic fibers made to look like natural grass, most often used in sports arenas but for residential lawns as well. The plurality of support layers 1 is then supported on a base surface 32 such as a layer of sand, and form, at upper sides 2 thereof, a closed support surface supporting the artificial turf assembly 32.

The support layer 1 is in the form of a rectangular support plate element formed of a polymeric foam and has an upper side 2 and a lower side 3, wherein, as mentioned, in use the support layer 1 has been placed with the lower side 3 thereof on a base surface and supports, on the upper side 2 thereof, the artificial turf assembly. At least in the present example, a length of the layer 1 is about 1.6 m and a width about 1.15 m.

The support layer is prepared from a polymer foam, preferably from expandable polyolefin beads that are expansion molded to provide the support layer. In an embodiment, the support layer consists of one or more expanded polypropylene (EPP) and/or one or more expanded polyethylene (EPE) materials or other materials. Co-polymeric foams may also be used as (part of) the polymeric foam. In addition, mixture of the same type of polymer may be used having a different density, for example a first EPP having a first density and a second EPP having a second density. Other examples of suitable materials are expanded polylactic acid (EPLA), expanded polystyrene (EPS) and mixture of all of these. The materials for use in the support layer according to the present invention may be so-called virgin (new) materials or may be recycled materials. Mixture of virgin and recycled materials may also be used. Any combination of type of polymer, density of polymer and origin (virgin versus recycled) may be used.

With "consists of" is meant consists for at least 90 wt. %, more preferably at least 95 wt. % of said expanded polymer. Other constituents may be for example fillers, colorant, stabilizers and other additives known to a person skilled in the art. The polymeric foam is preferably a so-called closed cell foam. The method of expansion molding using a closed mold under pressure is known in the art and will not be further explained here; usually steam is used to expand the polymeric beads which are optionally provided with an adhesive coating.

The support layer 1 comprises a plurality of through drainage holes 6 extending from the upper side 2 to the lower side 3 for allowing liquid such as rain water to flow via the plurality of drainage holes 6 from the upper side 2 to the lower side 3. The drainage holes 6 are evenly distributed over the support layer 1. At least in the present example a diameter of the holes is about 4 mm but may alternatively be in the range 1 to 20, preferably 3 to 10 mm.

The through drainage holes ensure that water, e.g. due to rain, is drained and removed from the artificial grass surface. The structure of the through drainage holes having widened entrance portion also ensures that any infill that is washed out will be trapped. The size and frequency of the drainage holes may be selected depending of the desired water extraction rate, which depends on the expected maximum rain fall in a certain geographical area where the support layer is to be used.

The support layer 1 also comprises a plurality of channels 4 at the lower side 3 for allowing liquid such as rain water to flow through the channels 4 along the lower side 3. A depth d of the channels is about 50 percent of a total thickness t of the layer 1.

The channels provided at the lower surface of the support layer preferably line up over the full length and width of the ground covering support structure allowing water to run to the sides of the field. This efficient water draining by water flow in the channels at the bottom side of the support layer is increased by a slope of e.g. 0.5% in the height of the base layer towards the sides of the filed in the same orientation as the channels.

Each of the drainage holes 6 debouches into one of the channels 4. The channels 4 extend mutually parallel over the entire lower side 3 of the support layer 1 and are fluidly connected to each other by means of a plurality of cross channels 8. The cross channels have a width which is about 50 percent of the width of the channels 4 and have a depth which is about 50 percent of the depth of the channels 4. See FIG. 5. The channels 4 extend in a length direction 10, whereas the cross channels 8 extends, also mutually parallel, at an angle α of about 35 degrees to the length direction 10, over the entire lower side 3 of the support layer 1.

The support layer also has a plurality of individual—preferably pyramid shaped—elevated portions 14 at the upper side 2. The elevated portions of the support layer provide improved drainage of the support layer by sloping towards the holes. The drainage holes 6 are provided in parallel rows 12 extending in a first direction 15, at 45 degrees to the length direction 10. The holes 6 in each of the rows 12 are spaced apart at a constant pitch p of about 42 mm, so as to define an area 13 between each four directly adjacent drainage holes 6. Also, each two adjacent drainage holes 6 in neighbouring rows 12 are spaced apart at a distance r of about 42 mm, wherein the distance r is thus equal to the pitch p, thereby defining a square area 13 between four directly adjacent drainage holes 6. See FIGS. 6 and 7. Each time an elevated portion 14 is formed on one of the areas 13. Thus, each elevated portion 14 has four drainage holes 6 along the circumference thereof, wherein a drainage hole 6 is present at each of the corners of said shape, except for some further elevated portions 14' at the sides of the layer.

Figure 3:
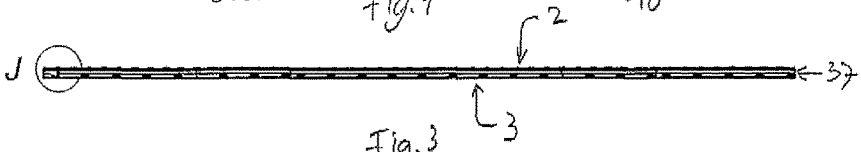
FIG. 3 shows a front view of the layer of FIG. 1.
Figure 4:
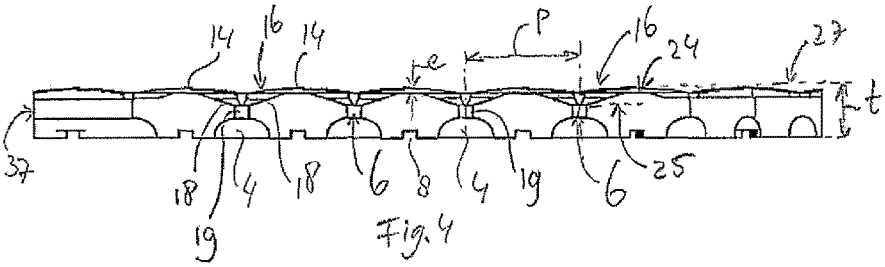
FIG. 4 shows section IV-IV of FIG. 1.
Figure 5:
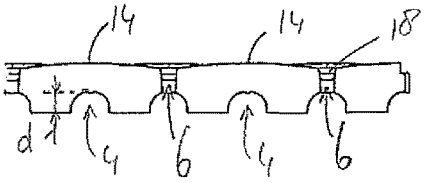
FIG. 5 shows detail V of FIG. 2.
Figure 6:
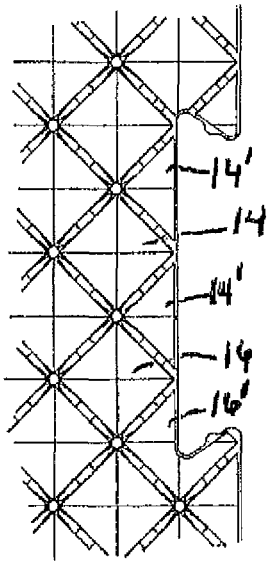
FIG. 6 shows detail VI of FIG. 1.
Figure 7:
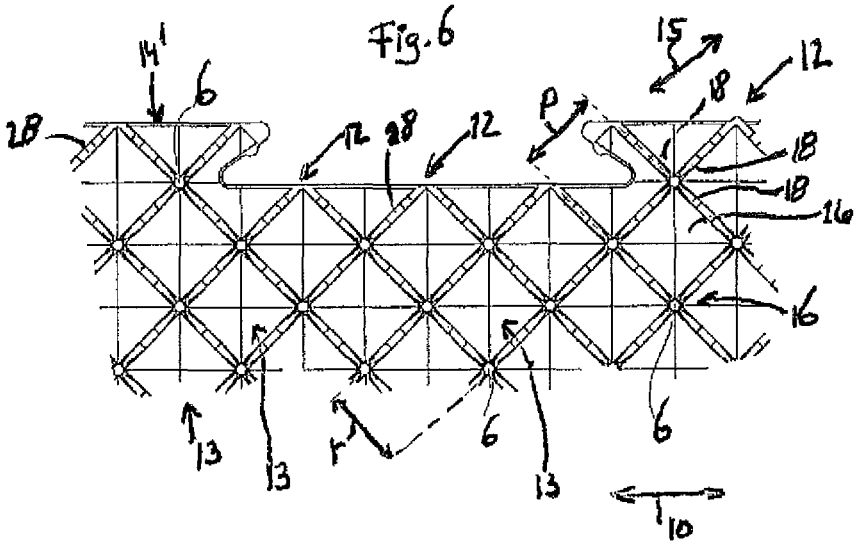
FIG. 7 shows detail VII of FIG. 1.

As in particular shown in FIGS. 3 and 4, each drainage hole has a widened entrance portion 16 at the upper side 2 of the support layer 1, to facilitate drainage to a larger extent. The widened entrance portion 16 is cross-shaped in plan view. The cross shape has four arms 18, each arm 18 being sloped, as shown in FIG. 4. As the figures show, two of the arms 18 extend in line with the direction of extension 15 of the rows 12, while the remaining two arms 18 extend perpendicular to direction 15. Below the entrance portion 18, the holes 6 have a main portion 19 which is of circular cross section but which may alternatively be of other cross sectional shapes such as square, oval or triangular, for example.

In an embodiment of the present invention, the widened entrance portion has a width of between 3 and 6 mm, preferably between 4 and 5 mm, such as between 4.2 and 4.8 mm.

In an embodiment of the present invention, the widened entrance portion has an angle with respect to the surface of the upper side of between 140° and 180°, preferably between 150° and 170°, such as between 160° and 165°.

The special effect of drainage holes with widened entrance portions is that these allow for an improved drainage as compared with holes not having these widened entrance portions; this without negatively affecting properties, such as shock absorption of the support layer.

Moreover, in a support layer having a plurality of individual elevated portions 14 at the upper side 2 and drainage holes with widened entrance portions, the elevated portions have a double function; i.e. water drainage to the drainage holes and uniform shock absorption in the support layer.

A support layer being formed of expanded polypropylene EPP and having pyramid shaped elevated portions 14 at the upper side 2, in which each drainage hole has a widened entrance portion 16 at the upper side 2 of the support layer, was tested according to the European Synthetic Turf Organisation (ESTO) Performance Guide for Shockpads. The results can be seen in the following table.

The widened entrance portion 16 has a width of 4.5±1 mm and an angle with respect to the surface of the upper side 2 of 161.6°±5%.

TABLE 1

| Property | Test Condition | Result | Requirement ESTO Guide |
|---|---|---|---|
| Thickness (mm) | EN 9863-1 | 23.4 | ≥8 mm |
| Mass (g/m$^2$) | EN 9863-1 | 885 | — |
| Density (g/L) | Calculated from mass | 38 | |
| Shock Absorption Triple A - (%) | Individual result Dry at 23 ± 2° C. | 69.1 | 25% |
| | Individual result Frozen | 69.1 | — |
| Vertical Deformation Triple A - (mm) | Individual result Dry at 23 ± 2° C. | 8.8 | — |
| Water Permeability (mm/h) | EN 12616 | 60000 | ≥500 |
| Horizontal water flow (l/s · m) | EST Guideline | | |
| | 0.1% Slope | 0.388 | |
| | 0.3% Slope | 0.645 | |
| | 0.5% Slope | 0.800 | |
| Tensile Strength (MPa) | Unaged EN 12230 | 0.18 | ≥0.15 |
| | After Air Ageing EN 13817/EN 12230 | 0.19 | |
| Tensile Properties % of unaged value (%) | — | 105 | ≥75% |

It can be seen in Table 1 that the support layer complies with the Guidelines of the ESTO Performance Guide for Shockpads.

Moreover, this support layer complies with the European EN 15330-1 standard and the latest FIFA Quality Concept for Artificial Turf. This support layer shows improved water drainage when compared to support layers not having the elevated portions and widened drainage holes having a widened entrance portion; furthermore, the shock absorption is uniform over the whole are of this support layer.

The different properties of the support layer according to the invention are measured or calculated under the following conditions.

The thickness and the mass are measured according to EN 9863-1 (CSN EN ISO 9863-1: Geosynthetics—Determination of thickness at specified pressures of 2016). The density is calculated from the mass.

The Shock absorption is measured according to the Guidelines of the ESTO at 23±2° C. and when the sample, i.e. the shockpad, is frozen, for example at a temperature ≤0° C.

The vertical deformation is measured with a dry sample at 23±2° C.

The water permeability is measured according to EN 12616 (CSN EN 12616; Surfaces for sports areas—Determination of water infiltration rate.)

The Horizontal water flow is measured according to ESTO Guidelines at three different slopes, e.g. 0.1%, 0.3% and 0.5%.

The Tensile strength is measured for an unaged sample according to EN 12230, whilst for a sample after air ageing is measured according to EN 13817/EN 12230 (DIN EN 12230: Surfaces for sports areas—Determination of tensile properties of synthetic sports surfaces). The Tensile properties are further given by the percentage of unaged value; this is calculated according to the ESTO Guidelines.

In an embodiment the support layer according to the invention has a shock absorption, measured according to the ESTO Guidelines, at 23±2° C. higher than 25%, preferably higher than 50%, more preferably higher than 80%, for example higher than 90%.

In an embodiment the support layer according to the invention has a shock absorption, measured according to the ESTO Guidelines, when said support layer is frozen, for example at a temperature ≤0° C., higher than 25%, preferably higher than 50%, more preferably higher than 80%, for example higher than 90%.

In an embodiment the support layer according to the invention has a water permeability, measured according to EN 12616, higher than 500 mm/h, preferably higher than 1000 mm/h, more preferably higher than 10000 mm/h, even more preferably higher than 50000 mm/h; for example, 60000 mm/h.

In an embodiment an unaged support layer according to the invention has a tensile strength, measured according to EN 12230, of at least 0.15 MPa, preferably, higher than 0.15 MPa, more preferably higher than 0.16 MPa, for example, 0.18 MPa.

In an embodiment a support layer according to the invention and after air ageing has a tensile strength, according to EN 13817/EN12230, of at least 0.15 MPa, preferably, higher than 0.15 MPa, more preferably higher than 0.16 MPa, for example, 0.19 MPa.

Thus, relative to a reference level 24 of the upper side 2, the slope of the arms 18 starts at this level 24 and slopes down to a lower level 25, at which level 25 the entrance portion 18 transitions into the main, circular, portion 19 of the hole. Also, the pyramid shaped elevations 14 start at the reference level 24 and rise to a top level 27. Consequently, the upper side 2 has flat surface portions 28 between elevated portions 14 and (entrance portions 18 of) holes 6. The shorter the arms 18 are, the larger the flat portions 28 will be. The flat portions 28 thus transition into, bottom surfaces of, the arms 18, in the example of the figures, as shown in FIG. 4, at an angle of about 20 degrees, in the direction 15, and transition into upwardly sloped surfaces of the pyramid shape of elevations, at an angle of about 10 degrees, transverse to the direction 15. Also see FIG. 12.

An elevation e of each elevated portion 12 is about 3 mm. A maximum thickness t of the support layer 1 is about 25 mm. Also, the polymeric foam has a material density of between 30 and 50 gram per liter, such as between 30 and 40 gram per liter. Also, the polymeric foam of which the support layer 1 is made, is a polyethylene foam.

The impact characteristics are measured using standardized testing procedures, such as for example but not limited to ASTM-F355 in the U.S. and EN-1177 in Europe and FIFA 2015 FQP test methods e.g. FIFA test methods 04a, 05a, 13. For example for soccer fields, the FIFA provides strict rules regarding impact that the artificial turf system has to comply to. The present support layer complies with the latest FIFA (Fédération Internationale de Football Association) Quality Concept for Artificial Turf, the International Artificial Turf Standard (IATS) and the European EN15330 Standard. Typical shock, or energy, absorption and deformation levels from foot impacts far such systems are within the range of 55-70% shock absorption and about 4 millimeters to about 9 millimeters deformation, when tested with the Berlin Artificial Athlete (EN14808, EN14809). Vertical ball rebound is about 60 centimeters to about 100 centimeters (EN12235), Angled Ball Behavior is 45-70%, Vertical Permeability is greater than 180 mm/hr (EN12616) along with other standards, such as for example energy restitution.

The support layer according to the invention may be in the form of a panel or plate several of which are used together to cover the base layer forming a ground-covering support system. The plates or panels according to the invention may be configured to have a puzzle-shape, such as by dovetail shaped joints as mentioned below, allowing interlocking connection to obtain a support system that is stable and does not have shifting of the separate support panels relative to each other.

Figure 1:
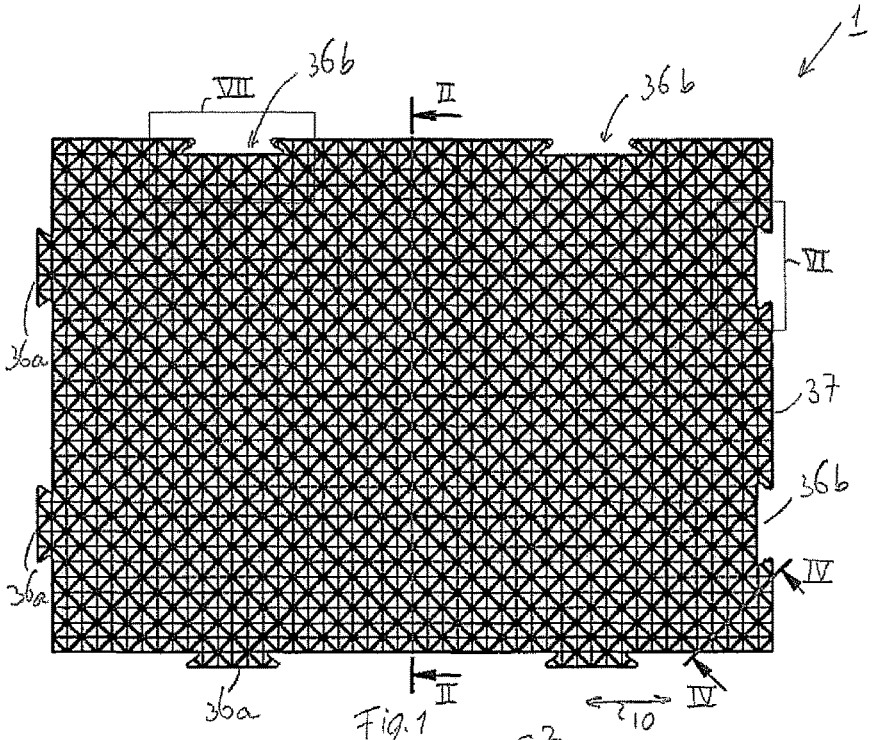
FIG. 1 shows, in plan view, an embodiment of a support layer according to the present invention.
Figure 2:
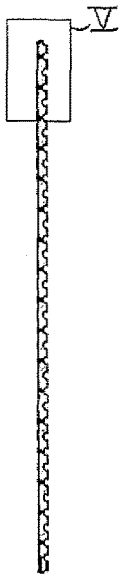
FIG. 2 shows section II-II of FIG. 1.
Figure 8:
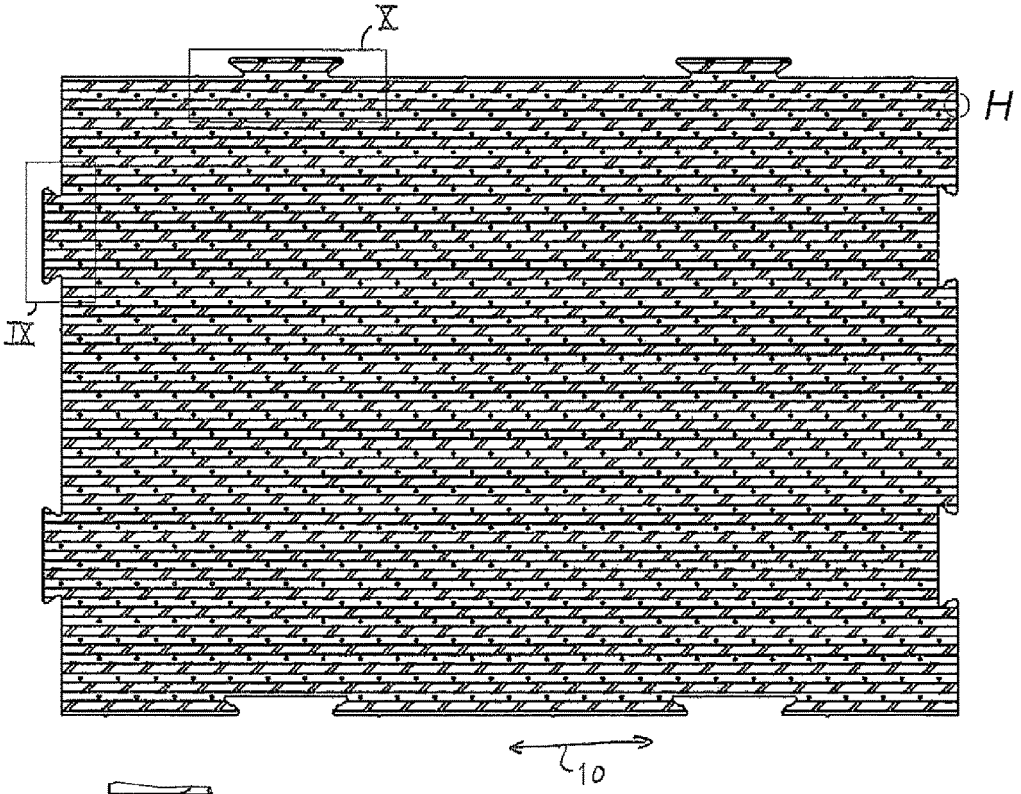
FIG. 8 shows, in bottom view, the support layer of FIG. 1.
Figure 9:
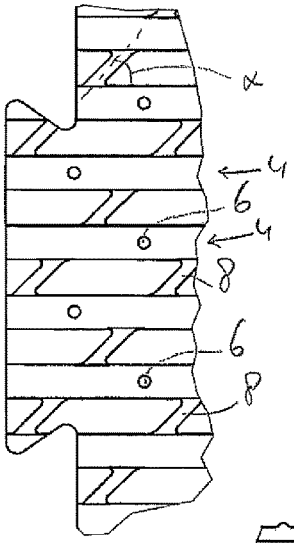
FIG. 9 shows detail IX of FIG. 8.
Figure 10:
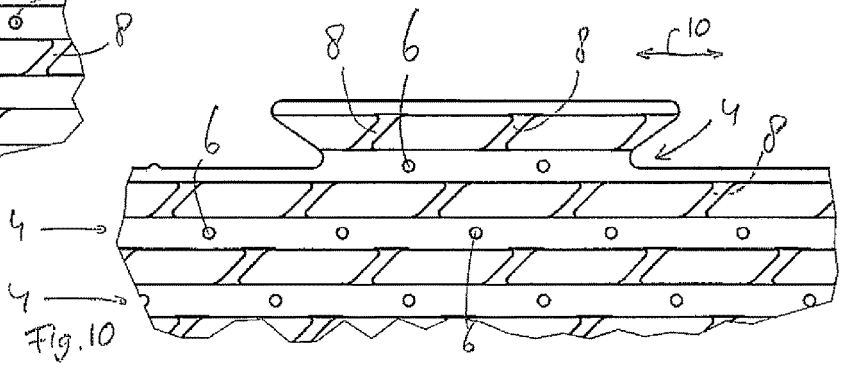
FIG. 10 shows detail X of FIG. 8.
Figure 12:
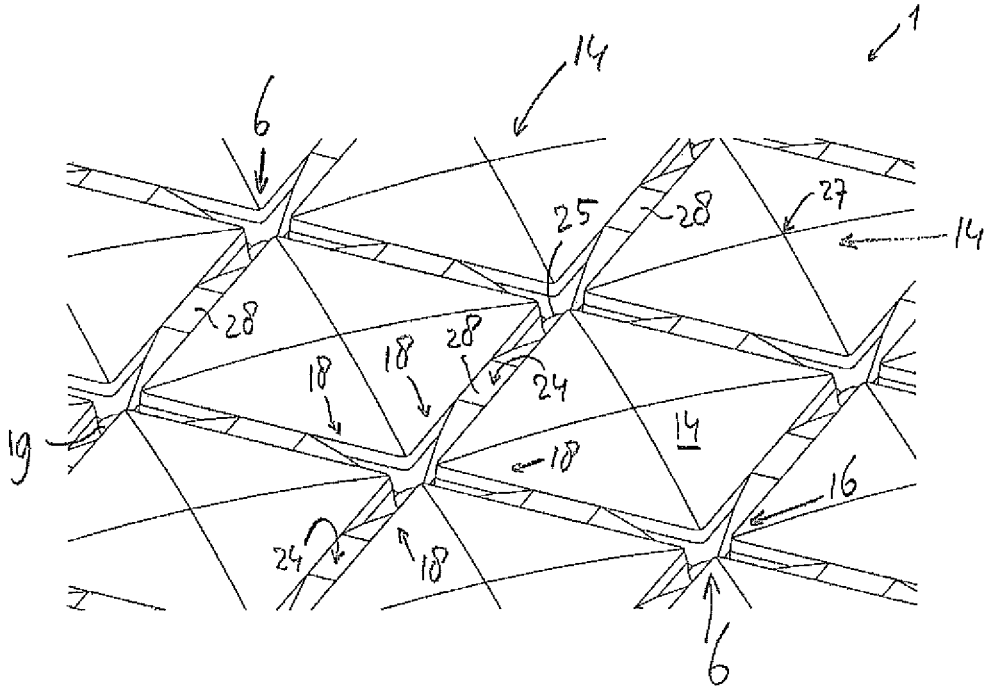
FIG. 12 shows, in 3-dimensional view, a part of an upper side of the support layer of FIG. 1.

As FIGS. 1 and 8 show in particular, the support layer 1 is of a generally rectangular shape and has connecting elements at a circumferential edge 37 thereof, in the form of dovetail joints 36*a* & 36*b*, for connecting the support layer 1 to further such support layers 1 and such that the connected support layers 1 are flush with respect to each other and form a closed surface for supporting thereon the artificial turf assembly 30. As shown, the layer 1 has male dovetail joints 36*a* on its left and bottom side in the view of FIG. 1, and has female dovetail joints 36*b* on its right and upper side in the view of FIG. 1. This way, the layer 1 can be easily and in a form closed manner be connected to further of such layers 1.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. Any reference signs in the claims should not be construed as limiting the scope thereof.

The following clauses define several aspects and embodiments of the invention.

1. A support layer (1) for supporting an artificial turf assembly (30), said support layer being formed of a polymeric foam and having an upper side (2) and a lower side (3), wherein in use the support layer (1) has been placed with the lower side (3) thereof on a base surface and supports, on the upper side (2) thereof, the artificial turf assembly, the support layer (1) comprising a plurality of through drainage holes (6) extending from the upper side (2) to the lower side (3) for allowing liquid such as rain water to flow via the plurality of drainage holes (6) from the upper side (2) to the lower side (3), and also comprising a plurality of channels (4) at the lower side (3) for allowing liquid such as rain water to flow through the channels (4) along the lower side (3), wherein each of said plurality of drainage holes (6) debouches into one of the plurality of channels (4), wherein said support layer (1) comprises a plurality of individual elevated portions (14) at the upper side (2) of the support layer (1) and said plurality of individual elevated portions (14) are dome, pyramid, truncated pyramid, cone, truncated cone or tetrahedron shaped, preferably, pyramid or dome shaped.

2. A support layer (1) for supporting an artificial turf assembly (30), said support layer being formed of a polymeric foam and having an upper side (2) and a lower side (3), wherein in use the support layer (1) has been placed with the lower side (3) thereof on a base surface and supports, on the upper side (2) thereof, the artificial turf assembly, the support layer (1) comprising a plurality of through drainage holes (6) extending from the upper side (2) to the lower side (3) for allowing liquid such as rain water to flow via the plurality of drainage holes (6) from the upper side (2) to the lower side (3), and also comprising a plurality of channels (4) at the lower side (3) for allowing liquid such as rain water to flow through the channels (4) along the lower side (3), wherein each of said plurality of drainage holes (6) debouches into one of the plurality of channels (4); and wherein drainage holes (6), preferably each drainage hole, of the plurality of drainage holes have a widened entrance portion (16) at the upper side (2) of the support layer (1).

3. A support layer (1) for supporting an artificial turf assembly (30), said support layer being formed of a polymeric foam and having an upper side (2) and a lower side (3), wherein in use the support layer (1) has been placed with the lower side (3) thereof on a base surface and supports, on the upper side (2) thereof, the artificial turf assembly, the support layer (1) comprising a plurality of through drainage holes (6) extending from the upper side (2) to the lower side (3) for allowing liquid such as rain water to flow via the plurality of drainage holes (6) from the upper side (2) to the lower side (3), and also comprising a plurality of channels (4) at the lower side (3) for allowing liquid such as rain water to flow through the channels (4) along the lower side (3), wherein each of said plurality of drainage holes (6) debouches into one of the plurality of channels (4), wherein said support layer (1) comprises a plurality of individual elevated portions (14) at the upper side (2) of the support layer (1) and said plurality of individual elevated portions (14) are dome, pyramid, truncated pyramid, cone, truncated cone or tetrahedron shaped, preferably, pyramid or dome shaped; and wherein drainage holes (6), preferably each drainage hole, of the plurality of drainage holes have a widened entrance portion (16) at the upper side (2) of the support layer (1).

The foregoing description provides embodiments of the invention by way of example only. The scope of the present invention is defined by the appended claims. One or more of the objects of the invention are achieved by the appended claims.

The invention claimed is:

1. A support layer for supporting an artificial turf assembly, said support layer comprising a polymeric foam having a density of between 20 and 70 grams per liter; and having an upper side and a lower side, wherein the lower side of the support layer is configured for placement on a base surface and the upper side is configured to support the artificial turf assembly thereon, the support layer comprising a plurality of through drainage holes extending from the upper side to the lower side for allowing liquid to flow via the plurality of drainage holes from the upper side to the lower side, and also comprising a plurality of channels at the lower side for allowing liquid to flow through the channels along the lower side, wherein each of said plurality of drainage holes debouches into one of the plurality of channels, wherein the drainage holes have a widened entrance portion at the upper side of the support layer, and wherein the widened entrance portion is star-shaped or cross-shaped in plan view, with a drainage hole located at the center of each respective shape and each arm of the respective shape is sloped towards its respective drainage hole.

2. The support layer according to claim 1, wherein the plurality of channels extend mutually parallel and are fluidly connected to each other by a plurality of cross channels.

3. The support layer according to claim 2, the plurality of cross channels have a smaller cross sectional area than the plurality of channels.

4. The support layer according to claim 2, wherein the plurality of channels extend in a length direction of the support layer, the plurality of cross channels extending, mutually parallel, at an angle ($\alpha$) ranging from 20 to 90 degrees relative to the length direction.

5. The support layer according to claim 1, further comprising a plurality of individual elevated portions at the upper side of the support layer.

6. The support layer according to claim 5, wherein the plurality of elevated portions are dome, pyramid, truncated pyramid, cone, truncated cone or tetrahedron shaped, and each of the plurality of elevated portions has at least three of the plurality of drainage holes along the circumference.

7. The support layer according to claim 5, wherein the plurality of drainage holes are provided in parallel rows extending in a first direction, the drainage holes in each of the parallel rows being spaced apart from one another at a constant distance and defining an area between each at least three directly adjacent drainage holes, and an elevated portion of the plurality of elevated portions is formed on each area.

8. The support layer according to claim 5, wherein an elevation of each of the plurality of elevated portions ranges from 1 to 5 mm.

9. The support layer according to claim 7, wherein each two adjacent drainage holes in neighboring rows are spaced apart at a distance, wherein the distance between the two adjacent drainage holes is equal to the pitch, defining a square area between four directly adjacent drainage holes.

10. The support layer according to claim 1, wherein a maximum thickness of the support layer ranges from 10 to 40 mm.

11. The support layer according to claim 1, wherein a depth of the plurality of channels ranges from 25 to 75 percent of a total thickness of the support layer.

12. The support layer according to claim 1, further comprising connecting elements at a circumferential edge thereof for connecting the support layer to further support layers such that the support layers are flush with respect to each other.

13. An artificial turf system, comprising an artificial turf assembly, and a support layer according to claim 1, supported on a base surface, wherein:

the support layer forms, at the upper sides thereof, a closed support surface supporting the artificial turf assembly.

* * * * *